US005289211A

United States Patent [19]

Morandotti et al.

[11] Patent Number: 5,289,211

[45] Date of Patent: Feb. 22, 1994

[54] INK DETECTING DEVICE FOR A LIQUID-INK PRINTING ELEMENT

[75] Inventors: Roberto Morandotti, Mercenasco; Alessandro Scardovi, Ivrea, both of Italy

[73] Assignee: Ing. S. Olivetti & C., S.p.A., Ivrea, Italy

[21] Appl. No.: 870,373

[22] Filed: Apr. 17, 1992

[30] Foreign Application Priority Data

Apr. 15, 1991 [IT] Italy ..... TO91A000283

[51] Int. Cl.[5] ..... B41J 2/175

[52] U.S. Cl. ..... 346/140 R; 73/304 R

[58] Field of Search ..... 346/140 R; 73/304 R; 304 C

[56] References Cited

U.S. PATENT DOCUMENTS

| | | | |
|---|---|---|---|
| 4,183,029 | 1/1980 | Isayama et al. | 346/140 R |
| 4,196,625 | 4/1980 | Kern | 73/304 R |
| 4,202,267 | 5/1980 | Heinzl et al. | 101/364 |
| 4,551,734 | 11/1985 | Causley | 346/140 |
| 4,630,758 | 12/1986 | Mutoh | 222/189 |
| 4,771,295 | 9/1988 | Baker | 346/1.1 |
| 4,812,859 | 3/1989 | Chan et al. | 346/140 R |
| 4,879,902 | 11/1989 | Loniello | 73/304 R |
| 4,929,969 | 5/1990 | Morris | 346/140 R |
| 5,051,759 | 9/1991 | Karita et al. | 346/140 R |
| 5,070,346 | 12/1991 | Mochizoki | 346/140 R |
| 5,119,115 | 6/1992 | Buat | 346/140 R |
| 5,162,817 | 11/1992 | Tajika | 346/140 R |
| 5,182,581 | 1/1993 | Kashimura | 346/140 R |

FOREIGN PATENT DOCUMENTS

| | | |
|---|---|---|
| 0370765 | 5/1990 | European Pat. Off. . |
| 0381392 | 8/1990 | European Pat. Off. . |
| 0408241A2 | 1/1991 | European Pat. Off. . |
| 0440110A1 | 8/1991 | European Pat. Off. . |
| 0444861A2 | 9/1991 | European Pat. Off. . |

*Primary Examiner*—Joseph W. Hartary

*Attorney, Agent, or Firm*—Banner, Birch, McKie & Beckett

[57] ABSTRACT

The ink detecting device gives advance warning of the end of the ink in a reservoir or cartridge feeding an ink-jet thermal print head. The device comprises a pair of electrodes that are immersed in a spongy, ink-soaked body contained in the reservoir, and are arranged in a region adjacent to the feed duct at which the spongy body has a 30% to 100% higher capillarity than in remote regions. The electrodes are connected to a bridge circuit which measures the electrical resistance of the ink between the two electrodes.

2 Claims, 3 Drawing Sheets

INK DETECTING DEVICE FOR A LIQUID-INK PRINTING ELEMENT

BACKGROUND OF THE INVENTION

The present invention relates to an ink detector for a liquid-ink printing element, and more particularly to an ink detector for indicating when a minimum amount of ink remains in the reservoir which feeds an ink-jet print head.

In thermal ink-jet heads, which are well known in the art, the nozzles, the spray chambers and the heating elements are formed on a multi-layer silicon-based chip manufactured by the known processes of vacuum deposition employed in the manufacture of integrated circuits.

In the case of multiple-nozzle heads, the various spray chambers are connected in parallel to a common collecting channel. This is connected in turn through a feed duct to a reservoir or replaceable ink cartridge.

An example of a multiple-nozzle thermal ink-jet print head is described in U.S. Pat. No. 4,812,859, in which a multi-layer silicon-based chip containing the spray chambers, the heating elements and the nozzles is attached directly to the ink reservoir. The reservoir contains a sponge impregnated with ink and is mounted on the carriage of a printer.

The use of sponges to reduce and stabilise the hydrostatic head in the outlet duct of an ink reservoir is also known from U.S. Pat. No. 4,630,758, in which it is shown that the sponge causes a pressure drop in the reservoir outlet duct by capillary action.

In European Patent Application published under No. 408,241 on 16 Jan. 1991, a thermal ink-jet print head is described in which the ink reservoir is of the replaceable cartridge type and is inserted on a support to which is fixed the multi-layer silicon-based chip containing the spray chambers, the heating elements and the nozzles. The cartridge contains an ink-soaked sponge and is able to form a fluid connection with the support to supply ink to the multi-layer chip.

However, the patents cited above make no mention of possible ways of monitoring the amount of ink remaining in the cartridge.

A number of devices for monitoring the amount of ink contained in a reservoir feeding a print head are known from U.S. Pat. Nos. 4,183,029, 4,196,625 and 4,202,267.

These patents relate in particular to feed reservoirs that are completely filled with ink and do not use a sponge. Electrodes are arranged in pairs on the floor of the reservoir next to the outlet duct, or, as in U.S. Pat. No. 4,183,029, directly inside the feed duct between the reservoir and the print head.

Measuring circuits connected to the electrodes measure the variation in the resistance of the ink between each pair of electrodes, and this corresponds to the decrease in the amount of ink remaining in the reservoir. When the electrodes become uncovered by the ink, the measuring circuit indicates that the ink has run out.

In these devices, the resistance of the ink varies slowly as the ink in the reservoir is used, and suddenly climbs to a very high level when the ink is finished.

It is therefore very difficult to determine when one has arrived at a minimum amount of ink before it is exhausted, so as to replace the cartridge or reservoir.

What is more, these devices cannot be adapted to reservoirs and/or cartridges containing an ink-soaked sponge, even if high-quality sponges are used such as those with a three-dimensional cross-linked structure of melamine-formaldehyde resin, as described for example in U.S. Pat. No. 4,929,969.

In this case, the balance between the capillarity of the nozzles and the capillarity of the terminal area of the sponge, close to the floor of the container, causes print deterioration or stoppage before the sensors on the floor of the container or in the outlet duct detect a significant rise in the increase of the resistance of the ink.

There is also known, from European Patent Application published under No. 370,765, another kind of end-of-ink detector formed by two electrodes placed in the ink feed duct leading to the spray chambers of a thermal ink-jet print head. One electrode is sited close to the spray chamber, while the other electrode is arranged upstream, towards the reservoir. A detector circuit indicates variations in the resistance of the ink between the two electrodes.

This type of detector, too, when applied to a reservoir containing an ink-soaked sponge, has the same disadvantages as indicated above.

SUMMARY OF THE INVENTION

Accordingly, there is a need for a device for giving reliable advance warning of the arrival at a minimum amount of ink, before print deterioration occurs or, worse still, a sudden interruption in the printing.

The present invention provides an ink detecting device for a liquid-ink printing element, comprising a reservoir containing an ink-soaked spongy body, a print head capable of selectively transferring small amounts of ink to the printing stock and provided with a fluid connection to said reservoir by means of a feed duct, and means for detecting the amount of ink contained in said reservoir, in which said detecting means comprise a first and a second electrode set inside said spongy body close to said feed duct, and a detection circuit for measuring the electrical resistance of the ink between said electrodes.

In a preferred embodiment of the invention described in more detail below, the spongy material comprises a first region having a first capillarity and a second region adjacent to the feed duct from the reservoir and having a second capillarity that is greater by 30% to 100% than the first capillarity.

The amount of ink in the reservoir can be detected by connecting a measurement bridge to the electrodes.

BRIEF DESCRIPTION OF THE DRAWINGS

These and other features of the invention will be made clearer in the following description of a preferred embodiment, which is given by way of non-limiting illustration, with reference to the drawings, in which.

DETAILED DESCRIPTION OF THE PREFERRED EMBODIMENT

Figure 1:
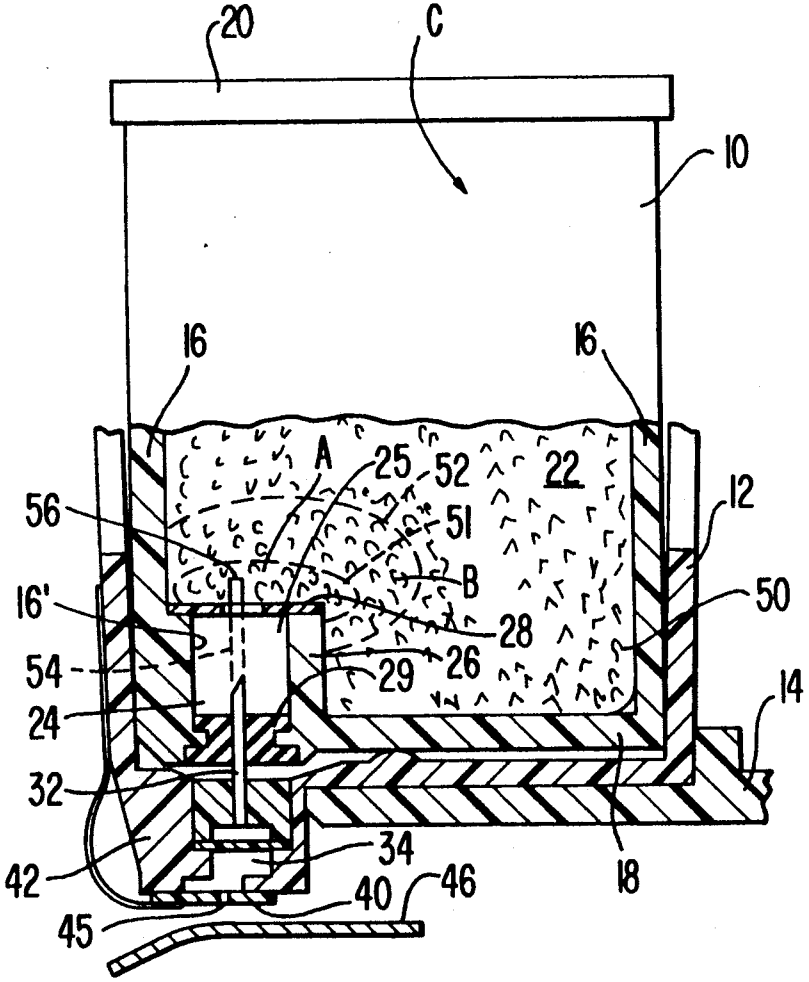
FIG. 1 shows an ink container of replaceable type, inserted in its support and including an ink detecting device embodying the invention.
Figure 6:
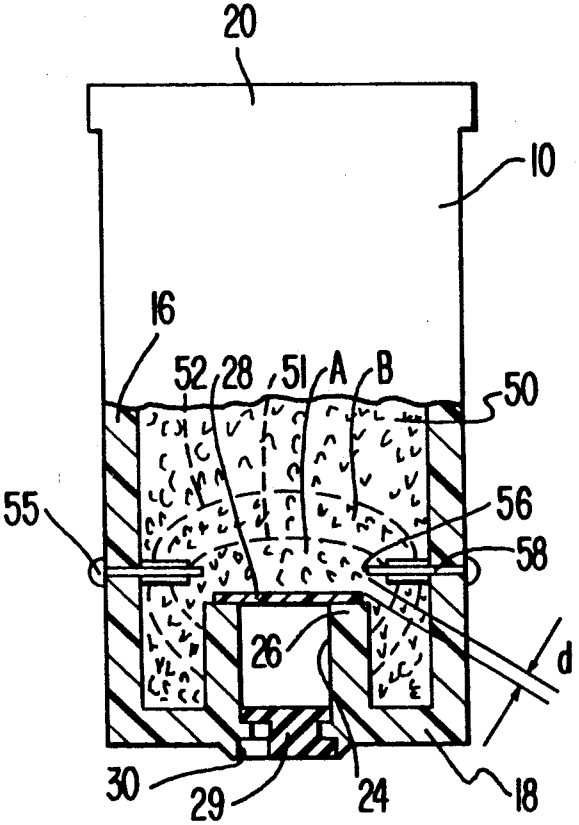
FIG. 6 shows the electrodes in a different position from FIG. 2.

FIG. 1 refers to an ink reservoir formed by a tank or replaceable-type cartridge 10. The cartridge 10 is inserted into a support structure 12 mounted firmly on a bearing surface 14 of a carriage in a thermal ink-jet printer (not shown in the drawings).

The cartridge 10 comprises four flat, rigid side walls 16 joined hermetically to a floor 18 and to a top lid 20. The walls 16, the floor 18 and the lid 20 together define a cavity 22 for holding a spongy body or sponge 50 impregnated with a certain amount of ink. The sponge 50 is made of a polyurethane material or any other kind of spongy material having regular capillarity and exhibiting chemical inertness in contact with printing inks.

Formed inside the cavity 22 is an outlet channel 24 comprising a chamber 25 defined by a curved wall 26 projecting perpendicularly to the floor 18 and by a portion 16' of one of the side walls 16. The chamber 25 is separated from the cavity 22 by means of a filter element 28, while a soft rubber diaphragm 29 is seated in an aperture 30 in the floor 18 to close off the bottom of the chamber 25.

When the cartridge 10 is inserted into the support 12, a needle-like tubular connecting element 32 perforates the diaphragm 29 and puts the chamber 25 in communication with a feed duct 34 formed in the support 12.

The duct 34 feeds the ink to a thermal ink-jet print head of a type known in the art and consisting of a chip 40 attached to one end 42 of the support 12 to close off the duct 34. The chip 40 is manufactured by the known method used for integrated circuits and comprises a series of nozzles 45 directed at the printing stock 46.

The use of a sponge, however, poses problems owing to the irregularities and defects of the internal holes and channels of the sponge. Owing to these irregularities and defects of the channels the ink may drain in a non-uniform manner, causing an uneven lowering of the ink level.

In certain cases selective draining has been observed to occur predominantly through areas of the sponge having channels with low capillarity, and only afterwards through areas with greater capillarity. As a result of this uneven draining, very often areas having channels with low density drain completely and let the ambient pressure communicate with the outlet duct, thereby facilitating the entry of air into the outlet duct.

These anomalies cause the flow of ink to the spray chambers to be interrupted ahead of time and printing to be interrupted suddenly and completely. Also the subsequent operation of the head is endangered owing to the formation of air bubbles in the duct 34 which should be kept completely full of ink at all times. The cartridge is therefore unusable and must be replaced, which of course means a waste of ink.

To avoid the above-mentioned problems, the spongy body or sponge 50 is compacted in the lower part of the cavity 22 in such a way as to form in the space around the chamber 25 a region A where the sponge 50 is relatively more compressed. This region A is basically concentric and has increasing capillarity with decreasing distance from the filter 28. As an indication, Figures 1 to 3 and 6 show region A bounded by a broken line 51 representing a dome-like surface wrapped around the chamber 25 at a distance from the wall 26 and from the filter 28 approximately equal to the radius r (FIG. 3) of the channel 24.

Normally the capillarity of the sponge 50 in uncompressed areas outside the surface 51 creates a pressure drop Po of between 10 and 17 cm of a column of water (c.w).

To ensure even draining throughout the body of the sponge 50, the sponge 50 should be compressed in the region A of maximum capillarity in such a way as to create a pressure drop P1 that is greater by 30% to 100% than the pressure drop Po when the ink fills the region A only.

Naturally, in a region B bounded by a broken line 52 and intermediate between the most compressed region A and the uncompressed region, the sponge 50 will assume a capillarity corresponding to an intermediate pressure drop between Po and P1.

Alternatively the spongy body forming the region A may be replaced by a portion of spongy material having a denser structure, while its size and capillarity are equivalent to those indicated for the region A, surrounded by a sponge of normal capillarity of the type present in the uncompressed region of the sponge 50.

In this way the draining of the ink proceeds gradually and uniformly, beginning with the regions furthest from the chamber 25 where the capillarity is low, for example near the lid 20. Draining then continues through the region B, and the region A is the last to be drained of its ink.

By virtue of the relatively higher capillarity of the region A, the pressure drop of the ink in the outlet channel 24 stays around values of approximately 10 to 17 cm (c.w), ensuring correct operation of the print head 40 (FIG. 1). This is because the pressure drop in the nozzles 45 caused by their capillarity is of the order of 25 to 60 cm (c.w), so that for the whole of the time that the cartridge 10 is draining, the ink is fed to the chip 40 through the duct 34 with a pressure drop sufficient to maintain the meniscus in the nozzles 45 in equilibrium, for correct operation of the head.

Figure 4:
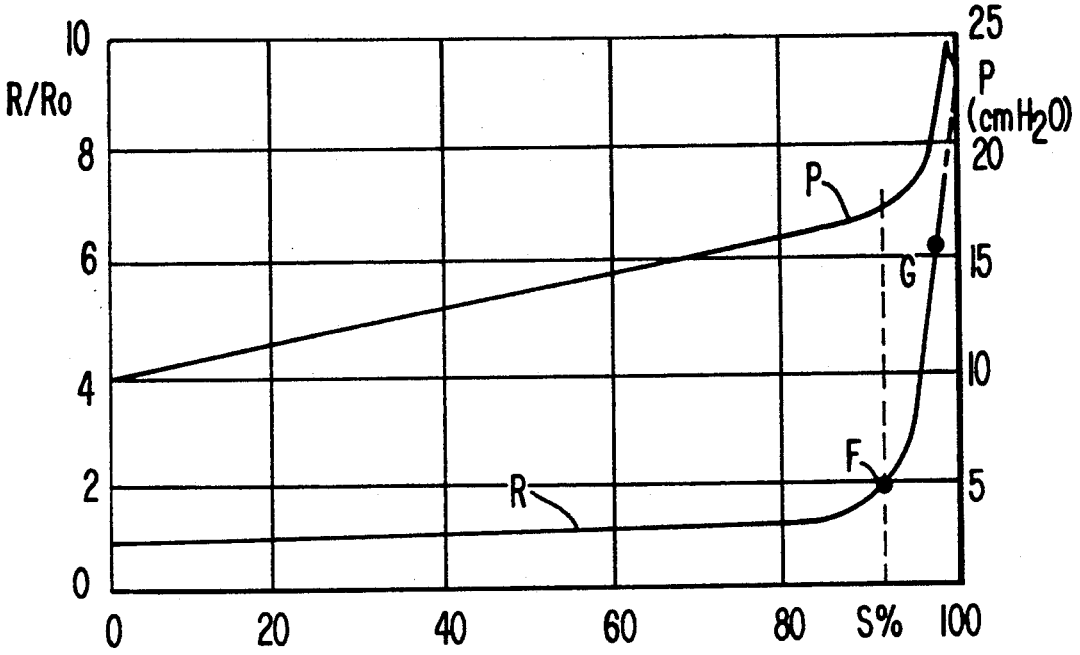
FIG. 4 is a diagram showing the pressure drop of the ink and of the gradient of the ink resistance.

FIG. 4 reproduces a diagram P of the pressure drop as a function of the percentage of draining of the ink, measured in the duct 34 in cm of a column of water. It can be seen that the pressure drop P increases slowly until the draining of the cartridge reaches the border of the region A (line 51) at approximately 90 to 95% of the total. Thereafter the pressure drop increases more rapidly, tending towards values comparable with those corresponding to the capillarity of the nozzles of the head.

Figure 2:
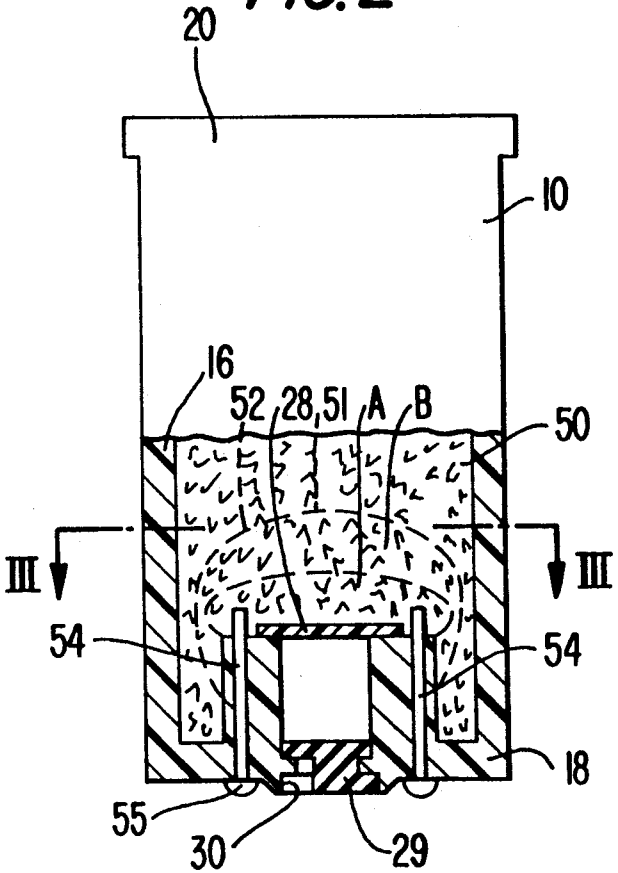
FIG. 2 shows a front view of the ink container only of FIG. 1.

To prevent this happening and to give suitable warning of the imminent exhaustion of the ink, the cartridge 10 is equipped with a pair of sensors or electrodes 54 (FIG. 2).

The pin-shaped electrodes 54 are fixed to the floor 18 perpendicularly thereto and in diametrically opposite positions with respect to the axis of the outlet channel 24. The uppermost tips 56 of the electrodes 54 are set within the sponge 50 in a position situated inside the region A, so that they are bathed by the ink flowing through the compressed sponge region of greater capillarity. It has been found experimentally that the tips 56 should preferably be placed inside the region A at a distance d from the wall 26 that is no greater than the radius r of the duct 24.

Each electrode 54 is immersed for most of its length in the wall 26 to leave uncovered only the tips 56 in contact with the ink.

Figure 5:
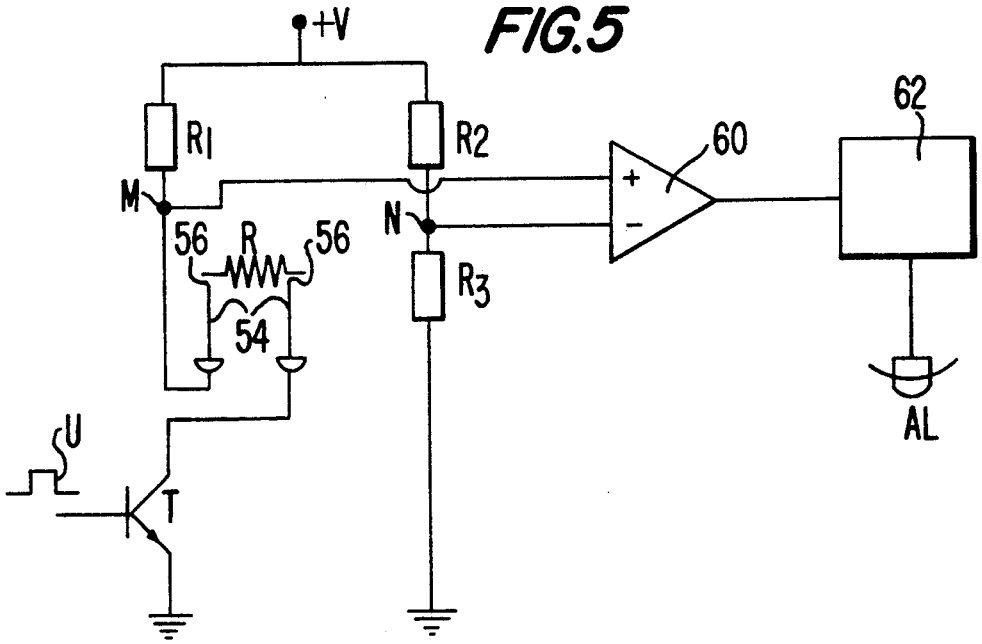
FIG. 5 shows a circuit for measuring the resistance of the ink.

The electrodes 54 project from the floor 18 with an enlargement 55 generous enough to guarantee a good electrical connection with corresponding contacts (not shown) situated on the support 12 in order to electrically connect the electrodes 54 to a detection circuit, shown in FIG. 5. The detection circuit comprises a bridge arrangement formed by resistors R, R1, R2, R3. The resistor R represents the resistance of the ink found between the tips 56 (FIGS. 2 and 5) of the electrodes 54. One of the two electrodes 54 is connected to the node M of the bridge, while the other electrode is taken to earth through a transistor T which is normally non-conducting. Across a diagonal MN of the bridge a comparator 60 is inserted, its output being connected to a monitoring circuit 62 which triggers an alarm AL when the comparator emits a signal, for example at high logic level. The bridge is supplied with a voltage +V and the values of the resistors R1, R2 and R3 are so chosen that when the sponge 50 (FIG. 2) is fully soaked with ink, and hence the resistance R has a relatively low value, the voltage at the node M (FIG. 5) is less than the reference voltage at the node N. In this condition the comparator 60 is therefore inactive.

As the ink in the sponge 50 (FIG. 2) decreases, the resistance R increases slowly (FIG. 4) until suddenly rising (section F–G in FIG. 4) when only the region A (FIG. 2) is still ink-soaked. In the diagram of FIG. 4, the ordinates on the left represent the ratio R/Ro between the resistance R of the ink measured between the electrodes 54 during draining and the value Ro of this resistance measured when the reservoir is filled with ink. The values of R and Ro can of course vary according to the type of ink used, the values of the resistivity of which are normally between 100 and 500 ohm/cm.

In this condition the voltage on the node M is greater than the reference voltage and the comparator 60 is activated to signal via the alarm AL (FIG. 5) the imminent exhaustion of the ink, in advance, before the first symptoms of malfunctioning of the print head appear.

The transistor T, which is normally non-conducting, prevents electrical current from continuing to flow through the ink which could be affected by electrochemical phenomena. A signal U turns on the transistor T at suitably-spaced intervals for as long as is required to perform the comparison of the voltages between M and N.

Figure 3:
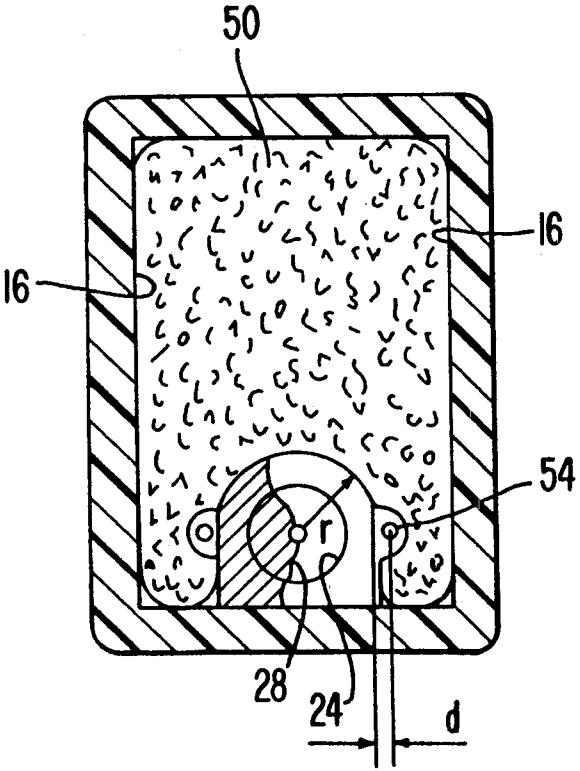
FIG. 3 shows a section taken through the line III—III of FIG. 2.

As an alternative, the electrodes 54 may be arranged in different positions from those indicated in FIGS. 1 to 3, for example (FIG. 6) they may be fixed to the side walls 16, both on the same side or on opposite sides, provided that the tips 56 are located within the region A of the sponge 50, preferably at a distance d from the upper rim of the wall 26 that is no greater than the radius r of the channel 24. The electrodes 54 comprise a stem 58 covered by insulating material except on the tips 56, to ensure electrical contact with the ink exclusively in the region A.

An ink detecting device embodying the invention can also be usefully employed on any kind of ink-using writing element, for example writing elements using a continuous flow of ink, or an ink-jet print head, whether they have their reservoir separable from the writing element, or are of the disposable variety in which the writing element is mounted directly on the reservoir.

It will be understood that in the ink detecting device parts may be added or replaced and shapes altered without thereby departing from the scope of the present invention.

We claim:

1. An ink detecting device for a liquid-ink printing element comprising:

a print head for selectively transferring small amounts of ink to a printing support; a reservoir containing an ink-soakable spongy body; a feed duct providing a fluid connection coupling said print head and an outlet portion of said reservoir; said spongy body including a first region having a first capillarity; and a second region adjacent to said outlet of said reservoir and having a second capillarity greater than said first capillarity; and first and second ink detecting electrodes mounted in said reservoir and in electrical contact only with said second region, each of said electrodes being fixed to a wall of said reservoir in diametrically-opposed positions with respect to the axis of said feed duct and consisting of a stem which is partially covered by insulating material and having a bare tip in electrical contact with the ink in said second region.

2. A replaceable ink cartridge for a print head comprising:

a reservoir having an outlet portion; an ink-soakable spongy body; said spongy body including a first region having a first capillarity, and a second region adjacent to said outlet of said reservoir and having a second capillarity greater than said first capillarity, and first and second ink detecting electrodes mounted in said reservoir and in electrical contact only with said second region, each of said electrodes being fixed to a wall of said reservoir in diametrically-opposed positions with respect to the axis of said feed duct and consisting of a stem which is partially covered by insulating material and having a bare tip in electrical contact with the ink in said second region.

* * * * *